United States Patent [19]

Ehring

[11] Patent Number: 4,631,753

[45] **Date of Patent: * Dec. 30, 1986**

[54] SLEEVE ATTACHMENT FOR MULTILAYERED PROTECTIVE COAT

[75] Inventor: Carolyn C. Ehring, West Caldwell, N.J.

[73] Assignee: Cairns & Brother, Inc., Clifton, N.J.

[ * ] Notice: The portion of the term of this patent subsequent to Oct. 1, 2002 has been disclaimed.

[21] Appl. No.: 774,904

[22] Filed: Sep. 11, 1985

Related U.S. Application Data

[63] Continuation-in-part of Ser. No. 651,801, Aug. 18, 1984, Pat. No. 4,543,670.

[51] Int. Cl.[4] ..... A41D 3/02

[52] U.S. Cl. ..... 2/85; 2/124; 2/269; 2/270

[58] Field of Search ..... 2/16, 85, 87, 124, 269, 2/270

[56] References Cited

U.S. PATENT DOCUMENTS 4,507,806 4/1985 Coombs ..... 2/85

4,543,670 10/1985 Ehring ..... 2/85

*Primary Examiner*—Louis K. Rimrodt

*Attorney, Agent, or Firm*—Louis E. Marn

[57] ABSTRACT

There is disclosed a novel sleeve attachment for a multilayered protective coat and comprised of a detachable wristlet assembly including a tubular wristlet and a flexible sleeve member circumferentially secured to the tubular wristlet. The flexible sleeve member is provided with a fastening means circumferentially secured thereto for cooperation with a fastening means circumferentially secured to an inner thermal layer sleeve of the multilayered protective coat for establishing a removable, circumferential attachment between the flexible sleeve member and the inner thermal layer sleeve.

6 Claims, 3 Drawing Figures

SLEEVE ATTACHMENT FOR MULTILAYERED PROTECTIVE COAT

This is a continuation-in-part application of U.S. patent application Ser. No. 651,801, filed Aug. 18, 1984, now U.S. Pat. No. 4,543,670, dated Oct. 1, 1985.

BACKGROUND OF THE INVENTION (1) Field of the Invention

This invention relates to a novel sleeve attachment for a multilayered protective coat, and more particularly to a sleeve attachment which includes a detachable wristlet assembly capable of telescoping axial movement with respect to a multilayered protective coat.

(2) Prior Art

In an effort to provide improved protection for firefighters, multilayered protective coats of the type, for example, described in U.S. Pat. No. 4,507,806, have been developed to provide more effective protective envelopes about the wearer thereof. Generally, a coat of such type includes: (i) a damage-resistant outer shell having an openable body portion with sleeves appended thereto, and a closure means such as a zipper or other fastening means for securing the openable body portion; (ii) an inner thermal liner comprised of a body portion having appended thereto sleeves and closure means which is substantially coincidental with the closure means of the outer shell; and (iii) a means for removably securing the outer shell to the inner liner. The inner liner of such a coat includes an interior thermal layer which is comprised of material suitable to provide thermal insulation, and a barrier layer comprised of a material suitable to provide a moisture barrier, the barrier layer being fixedly secured to the exterior surface of the thermal layer.

As multilayered protective coats for firefighters have been improved through the employment of more effective insulative materials, moisture barriers and protective outer shells to provide more effective protective envelopes, there has been the problem of entrapment within such protective envelopes of the moisture generated by the firefighter's own body. To obviate the difficulties presented to a firefighter as the result of the saturation of his inner garments due to such moisture entrapment, the multilayered protective coats of the aforesaid type are especially configured for prompt and simple assembly and disassembly, in the field or at the firehouse, so as to permit the removal of the prespiration soaked inner liner for replacement purposes, and/or for cleaning and drying of same.

In U.S. patent application Ser. No. 651,801, now U.S. Pat. No. 4,543,670 incorporated herein by reference, there is disclosed a sleeve attachment of a multilayered protective coat, comprised of a detachable innersleeve wristlet assembly including a tubular wristlet and a flexible innersleeve circumferentially secured to the tubular wristlet. The flexible innersleeve is folded in an axial direction to form a plurality of telescoping annular layers, and has circumferentially secured thereto a fastening means for cooperation with a fastening means circumferentially secured to the outer shell sleeve for establishing a removable, circumerential attachment between the flexible innersleeve and the outer shell sleeve.

OBJECT OF THE INVENTION

An object of the present invention is to provide a novel sleeve attachment of a multilayered protective coat including a detachable wristlet assembly capable of telescoping axial movement.

Another object of the present invention is to provide a novel sleeve attachment for a multilayered protective coat for providing wrist protection beyond a cuff area of an attaching sleeve.

Another object of the present invention is to provide a novel sleeve attachment for a multilayered coat including a detachable wristlet assembly which may be readily attached to, or detached from, such multilayered coat.

SUMMARY OF THE INVENTION

These and other objects of the present invention are achieved by a sleeve attachment for a multilayered protective coat and comprised of a detachable wristlet assembly including a tubular wristlet and a flexible sleeve member circumferentially secured to the tubular wristlet. The flexible sleeve member is provided with a fastening means circumferentially secured thereto for cooperation with a fastening means circumferentially secured to an inner thermal layer sleeve of the multilayered protective coat for establishing a removable, circumferential attachment between the flexible sleeve member and the inner thermal layer sleeve.

BRIEF DESCRIPTION OF THE DRAWINGS

A better understanding of the present invention as well as other objects and advantages thereof will become apparent upon consideration of the following detailed disclosure thereof, expecially when taken with the accompanying drawings, wherein.

DETAILED DESCRIPTION OF THE INVENTION

Figure 1:
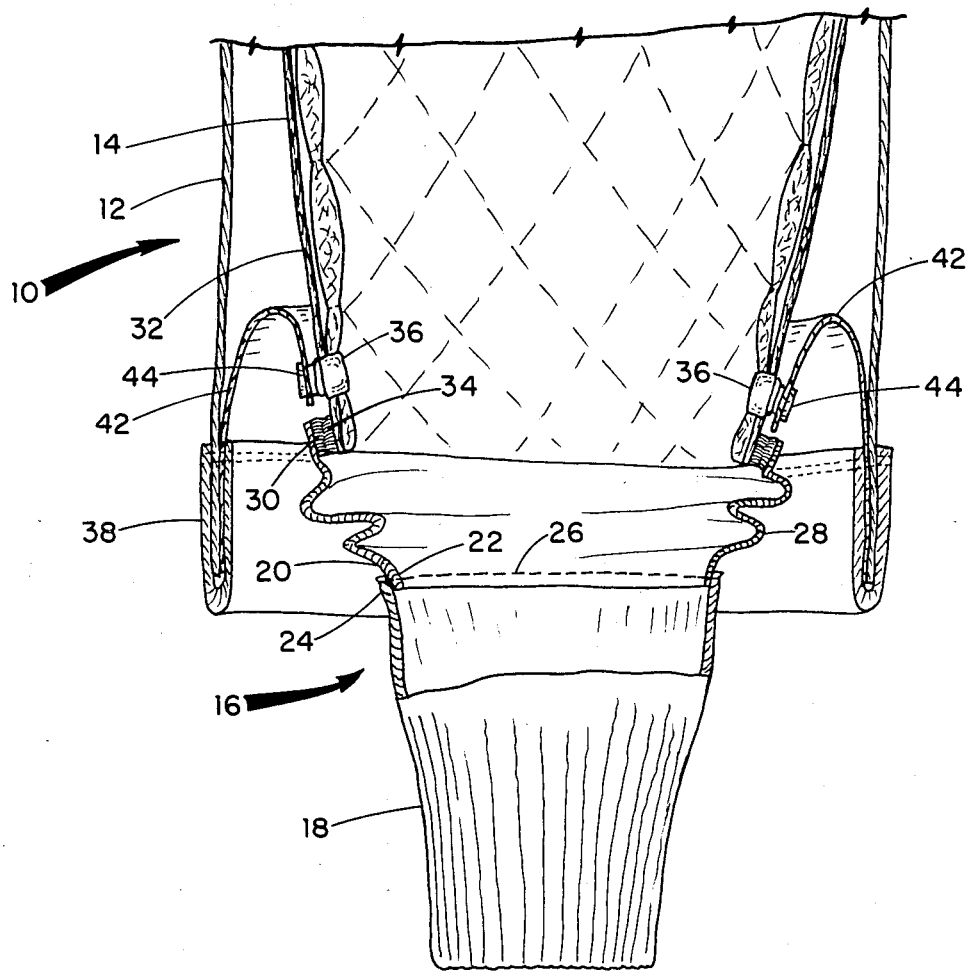
FIG. 1 is an elevational view of an embodiment of the present invention in which a wristlet assembly is circumferentially attached to an outer surface of an inner thermal layer sleeve of a firefighter's multilayered protective coat.
Figure 2:
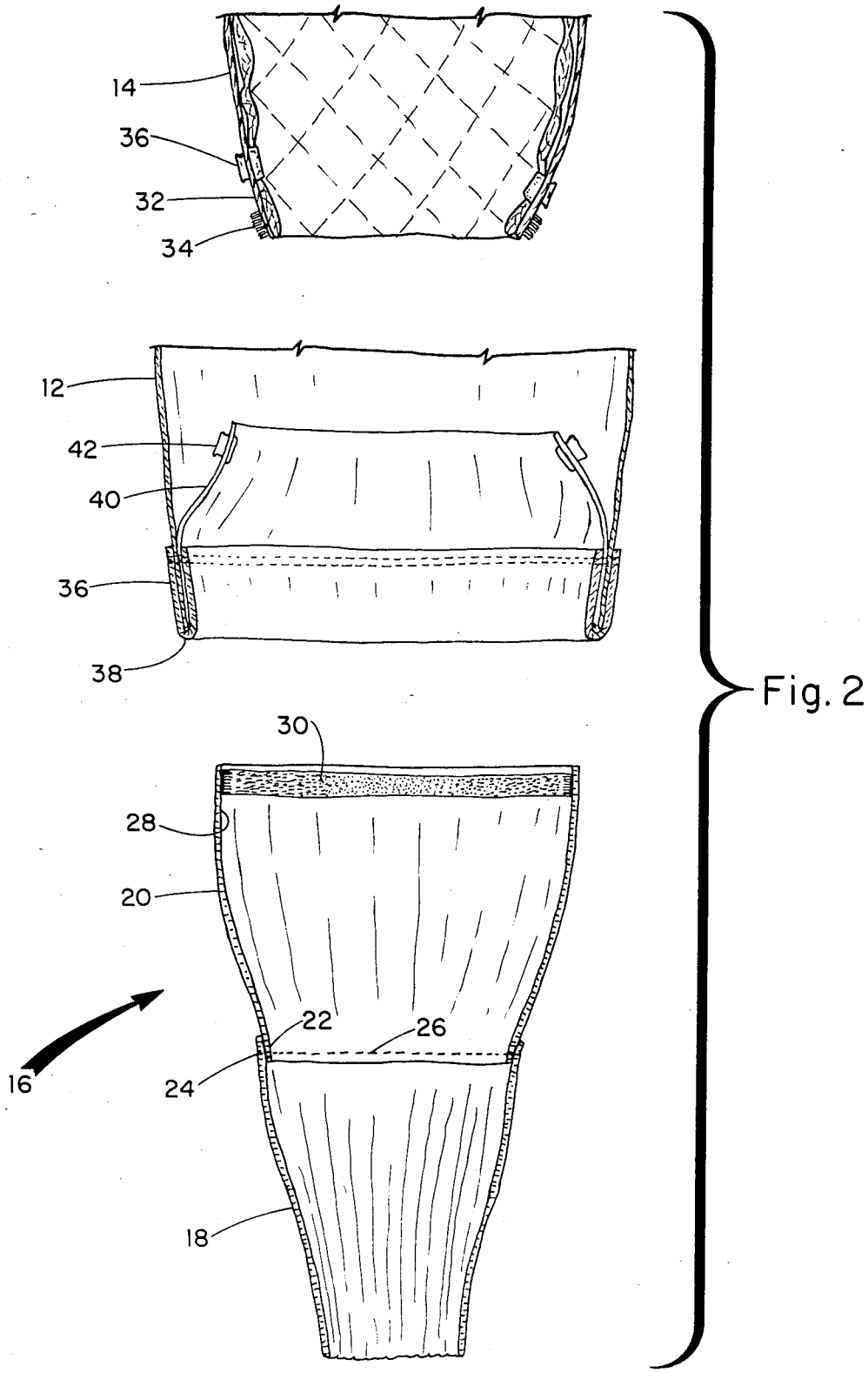
FIG. 2 is an exploded elevational view of the embodiment depicted in FIG. 1.

Referring to FIGS. 1 and 2, there is illustrated a sleeve portion of a firefighter's multilayered protective coat, generally indicated as 10, and comprised of an outer shell sleeve 12 of damage-resistant material suitable for providing fire protection, and positioned therewithin, a thermal layer sleeve 14. The firefighter's protective coat is of the type disclosed in the aforesaid U.S. Pat. No. 4,507,806. Further, illustrated is a wristlet assembly, generally indicated as 16, which includes a wristlet member 18 and a flexible sleeve member 20 which are formed of a unitary configuration. The wristlet member 18 is comprised of a thermal insulative material for fire protection and is formed in a manner to provide a snug elastic fit on the wearer's wrist. The sleeve member 20 is comprised of a flexible, insulative material for fire protection (for example, a thermal insulative material such as Kevlar ® coated with neoprene). A peripheral portion 22 of the sleeve member 20 is positioned within and circumferentially secured to a peripheral upper portion 24 of the wristlet member 18 to form a circumferential attachment 26. The sleeve member 20 has a cross-section that increases in circumference in the axial direction away from the peripheral portion 22, thus permitting the sleeve member 20 to be sinusoidally folded in an axial direction. Circumferentially secured about an upper portion of an inner surface 28 of the sleeve member 20 of the wristlet attachment assembly 16 is a fastening member 30, such as one component of a VELCRO® fastening assembly, it being understood that other suitable fastening means may be used without departing from the scope of the invention.

On an outer surface 32 of the inner thermal layer sleeve 14 proximate a terminal portion thereof, there is circumferentially secured thereto a fastening member 34, such as a cooperating component of a VELCRO® fastening assembly. The outer surface of the inner thermal layer sleeve 14 is also provided with snap fastening elements 36 positioned above the fastening member 34. The outer shell sleeve 12 is provided with an annular cuff reinforcement member 38. During attachment of the annular cuff reinforcement member 38, there are disposed restraining tab elements 42 including snap fastening elements 44 to which are attached the snap fastening elements 36 mounted to the outer surface 32 of the inner thermal layer sleeve 14.

To achieve the condition of attachment of the sleeve wristlet assembly 16 illustrated in FIG. 1, the fastening member 30 thereof is peripherally mounted to the fastening member 34 of the thermal layer sleeve 14 with detachment effected by a reverse procedure. To ensure continued proper alignment between the outer shell sleeve 12 and the inner thermal layer sleeve 14, particularly during use, the snap fastening elements 44 and 36 thereof are placed into snapped engagement.

Figure 3:
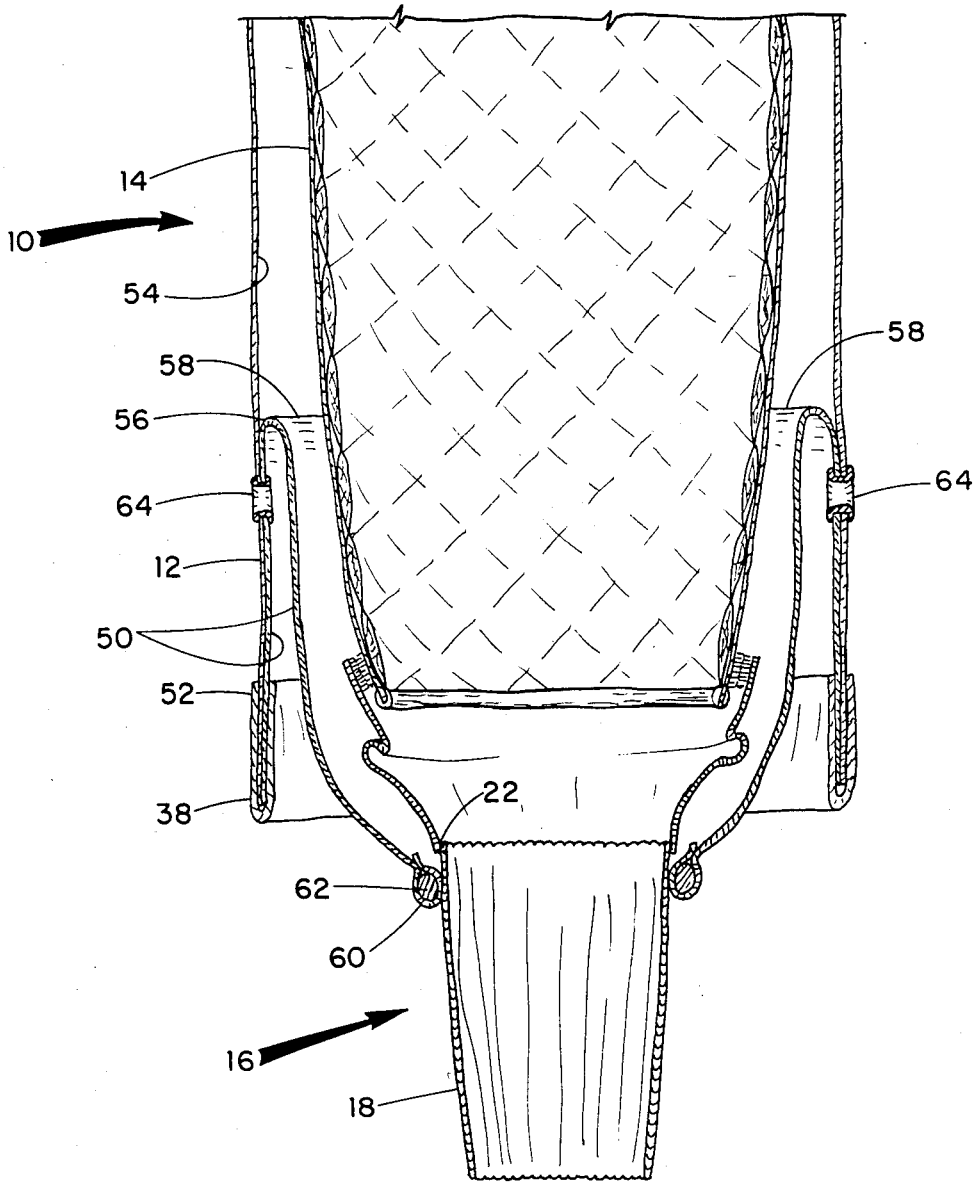
FIG. 3 is an elevational view of the embodiment of the present invention positioned in another form of the multilayered protective coat.

In FIG. 3, there is illustrated the wristlet assembly 16 of the present invention positioned within a multilayered protective coat 10 wherein the outer shell sleeve 12 is provided with a tubularly-shaped waterwell member 50 formed of a water repellant fabric. An end 52 of the waterwell member 50 may be secured within the annular cuff reinforcement member 38 of the outer shell 12 with the waterwell member 50 being disposed along a portion of an inner surface 54 thereof to a point where an intermediate portion 56 of the waterwell member 50 is circumferentially secured, as by sewing, about the inner surface 54 of the outer shell sleeve 12 forming a circumferential attachment 58 therefor. A free end 60 of the waterwell member 50 opposite the end 52 thereof is provided with a circularly-shaped elastic member 62 circumferentially affixed, such as by sewing, to the free end 60.

The tubularly-shaped waterwell member 50 is dimensioned lengthwise for positioning about the wristlet member 18 of the sleeve wristlet assembly 16 once the wearer has donned the multilayered protective coat 10 and properly affixed the sleeve member 20 of the sleeve wristlet assembly 16 to the thermal layer sleeve 14 and relatively positioned the wristlet member 18 on the wearer's wrist. Since the waterwell member 50 is formed of a water repellant fabric, a plurality of eyelets 64 are peripherally disposed in the sleeve of the outer shell 12 and the waterwell member 50 between the annular reinforcement cuff reinforcement member 38 and the circumferential attachment 58 to provide for drainage of fluid which might be captured in the annular trough formed by the waterwell member 50 when the arm of the wearer is in an upright position during an actual firefighting situation or firefighting drill.

While the invention herein has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited to the claims and the equivalents thereof.

What is claimed is:

1. In a multilayered protective coat for firefighters, a novel sleeve attachment comprising:

an outer shell sleeve having a cuff assembly including an annular cuff layer secured to said outer shell sleeve;

a thermal layer sleeve positioned within said outer shell sleeve having a first fastening strip circumferentially secured thereto; and a wristlet assembly including a wristlet comprised of thermal insulative material and a sleeve member comprised of thermal, insulative material, said sleeve member secured to said wristlet, a second fastening strip circumferentially secured to said sleeve member to provide circumferential attachment between said sleeve member of said wristlet attachment assembly and said thermal layer sleeve.

2. The novel sleeve attachment as defined in claim 1 wherein said first fastening strip is secured to an outer surface of said thermal layer sleeve and said second fastening strip is secured to an inner surface of said sleeve member of said wristlet attachment assembly.

3. The novel sleeve attachment as defined in claim 1 and further including a first connecting means provided on said outer shell sleeve and a second connecting means provided on said thermal layer sleeve for connective cooperation to limit relative movement between said outer shell sleeve and said thermal layer sleeve.

4. The novel sleeve attachment as defined in claim 1 and further including a tubularly-shaped waterwell member secured to an inner surface of said outer shell sleeve, said waterwell member having a circularly-shaped elastic member of reduced diameter secured in a free end of said tubularly-shaped waterwell member.

5. The novel sleeve attachment as defined in claim 4 wherein said waterwell member is circumferentially secured to said inner surface of said outer shell sleeve a predetermined distance from a free end portion of said outer shell sleeve.

6. The novel sleeve attachment as defined in claim 5 wherein said waterwell member is dimensioned lengthwise as to be positioned during use on said wristlet attachment assembly.

* * * * *